United States Patent [19]

Freedom et al.

[11] Patent Number: 4,737,619

[45] Date of Patent: Apr. 12, 1988

[54] FERTILITY CALCULATOR

[76] Inventors: John Freedom, 17100 S. Harlem Ave., Tinley Park, Ill. 60477; Thomas Freedom, 12800 S. 84th Ave., Palos Park, Ill. 60464

[21] Appl. No.: 888,515

[22] Filed: Jul. 23, 1986

Related U.S. Application Data

[63] Continuation-in-part of Ser. No. 736,108, May 20, 1985, Pat. No. 4,625,099.

[51] Int. Cl.[4] ..... G06C 3/00

[52] U.S. Cl. ..... 235/88 RC; 235/78 RC

[58] Field of Search ..... 235/78 R–78 RC, 235/83, 84, 88 R–88 RC

[56] References Cited

U.S. PATENT DOCUMENTS 2,638,272 5/1953 Heck ..... 235/88 RC 4,625,099 11/1986 Freedom ..... 235/88 RC

*Primary Examiner*—Benjamin R. Fuller

*Attorney, Agent, or Firm*—Basil E. Demeur; Robert E. Knechtel

[57] ABSTRACT

There is disclosed a calculator adapted to determine optimum fertility time periods for a female, formed by a first scale divided into 365 equal units, each unit assigned a day for each month of a full calendar year, a second scale positioned in operative relation to the first scale, the second scale including a first information segment formed by a series of 15 equal units, each unit representing a day in a menstrual cycle and ranging between 20 such days in a cycle and 35 days in a cycle, and a second information segment positioned a predetermined distance forward of the first information segment, the second information segment comprising the optimum fertility indicator segment and constructed by measuring a time period two days prior to and two days subsequent to the day of ovulation, the optimum fertility indicator segment constructed in the form of a box having a total of eight equal units from end to end, the center unit representing the point of ovulation, and the two markings measured therefrom each being spaced two equal units forward and rearward therefrom, the units being measured identically to the units formed on the first scale, whereby the optimum fertility period may be determined by the user thereof by placing the known number of days in a female's menstrual cycle from the second scale in registry with the date when the last menstrual cycle commenced as measured on the first scale, thereby to bring into registry the second information segment on the second scale with a certain time period as read from the first scale thereby to determine the time period of maximum fertility, and also showing the time period of non-fertility.

5 Claims, 1 Drawing Sheet

FERTILITY CALCULATOR

REFERENCE TO CROSS RELATED APPLICATION

This application is a continuation in part application of application Ser. No. 736,108 filed on May 20, 1985, U.S. Pat. No. 4,625,099, in the name of John Freedom, which application is presently pending.

BACKGROUND OF THE INVENTION

The present invention concerns itself with providing a noval calculator intended to provide fertility information to the female user thereof. One of the difficulties which as prevailed in the filed of gynecology has been the inability to accurately predict the time periods, on a monthly basis, when a female is most likely to conceive. It is well known that this information is of critical importance to females having difficulties in understanding and predicting the optimum time periods when conception is most likely to occur, and therefore, experts in the field have employed a host of methods and modes of treatment, including treating female patients with a variety of hormones in order to optimize fertility time periods.

Prior art calculators which have been created exist primarily for the purpose of predicting when a birth will occur if the approximate time of conception is known. Such calculators generally are designed by having a base scale which is divided into the calendar months of a year based upon a 365 day year, and a second scale rotatably movable with respect to the first scale which defines the least menses begun by the female, and then extrapolating a possible date of conception, and then determining the probable implantation and from that date measuring the trimesters until the calculated date of conception can be read from the base scale. Such calculators are fairly common, and again, are merely intended to give a female an expected birth date of a child, primarily based upon the last determinable day when a previous menses occurred. However, heretofore, no calculator has been provided which will provide information to the female user thereof to indicate an optimum fertility time period, or in the alternative, to indicate an optimum infertility time period.

It is deemed to be quite relevant and important in the field of gynecology and obstetrics to provide a mechanism whereby a female will have the opportunity to determine the most likely time periods on a monthly basis when conception is possible which can be utilized, at least in a first attempt to achieve conception without the need of any mode of treatment with hormones or other such modes of treatment. If is deemed desirable to provide a simple calculator which is designed to calculate optimum fertility time periods regardless of the actual menstrual cycle of a female, so long as such cycles fall within the overall general average of menstrual cycles. Hence, the calculator of the present invention will function, if properly utilized, to indicate the optimum periods of fertility, as well as the optimum periods of infertility.

A fertility calculator of the type generally described herein has been set forth in my co-pending application Ser. No. 736.108, which illustrates a calculator having a first scale divided into 365 equal units, each unit assigned a day for each month of a full calender year, and a second scale positioned in operative relation to the first scale, wherein the second scale includes a plurality of information segments. Each of the information segments is sized to correspond with a different menstrual cycle length calculated by the time period between the first day of successive menstrual cycles and was designed to range between a 23 day cycle, and a 35 day cycle. As was disclosed and claimed therein, each of the information segments was spaced from the next adjacent information segment by a spacer segment each of the spacer segments being of equal size. Hence, in the fertility calculator as disclosed therein, there were a total of 13 information segments, and 13 spacer segments, thereby to form a total of 26 segments throughout a 360° arc. The calculator is utilized by manipulating the second scale in order to place the indicator indicating the first day of a menstrual cycle of a given cycle length in registry with a particular day and month as noted on the first scale, representing the date of the previous menstrual cycle, and reading from the optimum fertility indicator formed on the second scale the certain days of the month which would be the optimum fertility time period for conception. While the fertility calculator as disclosed and claimed therein operates in the manner indicated, and does in fact function to provide the user thereof with the necessary information such as optimum fertility periods as well as periods of infertility, it was determined that the device could be simplified by rearranging and re-designing the information segments on the second scale to make the entire calculator easier to use. Hence, the present invention was developed from the standpoint of greater simplicity, and further expanding the use of the calculator by expanding the cycle lengths to include cycle lengths as short as 20 cycle days. The present invention as described herein is intended to provide an improved and more simplified fertility calculator as will be more fully described hereinafter.

OBJECTS AND ADVANTAGES

It is therefore the object of the present invention to provide a calculator adapted to determine optimum monthly fertility time periods of the female regardless of variations in menstrual cycle lengths, so long as such cycle lengths fall within the overall averages of between 20 and 35 days, and further calculated on the basis of ovulation occurring approximately 14 days prior to the commencement of the next menstrual cycle, such that the simple manipulation of a 2-scale calculator will yield information as to the optimum fertility time period for each month.

In conjunction with the foregoing object, it is a further object of the present invention to provide a calculator of the type described, which includes a first scale divided into 365 units representing a day in each month of a full calendar year, and a second scale positioned in operative relation with respect to the first scale, the second scale including a first information segment formed by a series of 15 equal units being dimensionally sized to correspond with the units on the first scale, and representing cycle days in a menstrual cycle period ranging between 20 and 35 day cycles, and a second information segment representing an optimum fertility information segment formed by a series of 4 units, each unit being twice as large as the units on the first scale, the optimum fertility information segment being spaced forwardly of the first information segment by a distance equalling 2 units as measured from the first scale, whereby the manipulation of the second scale in a manner which places the menstrual cycle time period in registry with the data on the first scale upon which the previous menstrual cycle commenced, permits the user to read from the second information segment the calendar month and day upon which ovulation will occur, and the time period during which optimum fertility will be experienced.

In conjunction with the foregoing object, it is a further object of the invention to provide a calculator of the type described wherein there is further provided a third information marker spaced forwardly from the second information segment on the second scale, a third information marker being spaced forwardly a distance equal to 10 units of the same dimension of the units incorporated on the first scale, the third information marker representing the date upon which the next menstrual cycle will commence once the user has manipulated the same to determine a given optimum fertility time period.

SUMMARY OF THE INVENTION

In summary, the present invention is to provide a simplified but improved calculator which is adapted to permit information as to optimum fertility time periods on a monthly basis to be quickly and efficiently determined by the user thereof. The calculator of the present invention is intended as an improvement over the calculator as disclosed in my co-pending application Ser. No. 736,108, wherein the second scale has a more elaborate format in that it is formed by a series of 13 information segments, and 13 spacer segments, for a total of 26 segments imprinted thereon. The calculator of the present invention eliminates all of those segments, and incorporates on the second scale 2 simplified information segments and a third information marker all of which give the user the same if not more information.

In summary, the calculator of the present invention includes a first scale which incorporates 365 units representing the calendar days in a 12 month year, and the second scale includes a first information segment formed by a series of 15 units, each unit being the same dimension as the units on the first scale, and representing cycle days between 20 and 35 menstrual cycle days, and the second information segment being optimum fertility information segment which is formed by 4units, each unit being precisely double the size of the units located on the first scale, and representing a series of 8 days which when properly positioned relative to scale 1, would indicate the optimum fertility time period.

It is contemplated that the calculator of the present invention will be useful in between 95 and 99% of females given the fact that on an average basis, ovulating menstrual cycles have been found to range from as low as 20 days to as high as 35 days. In this connection, it is noted that the calculator defined in my co-pending application is based upon menstrual cycles ranging between 23 days and 35 days, and it is now recognized that menstrual cycle periods of as low as 20 days are experienced in a number of female individuals. Therefore, the present calculator has greater use in that it accommodates menstrual cycle lengths as low as 20 days. Hence, for females having menstrual cycles within the range of 20 to 35 days, the calculator of the present invention will provide an indication as to the optimum fertility time periods for achieving conception, and will further indicate optimum time periods when infertility is most likely.

DETAILED DESCRIPTION OF DRAWINGS

Figure 1:
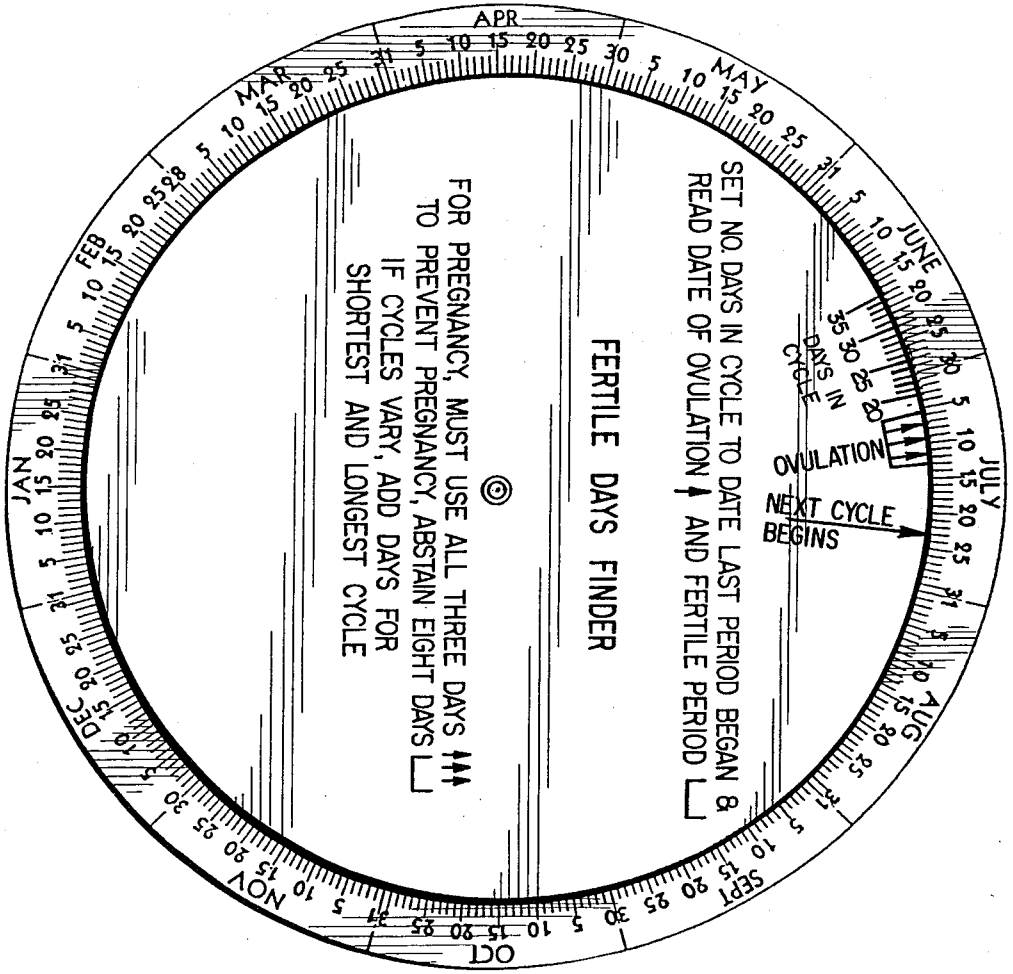
FIG. 1 is a top plan view showing the calculator of the present invention and indicating the base scale having the days of the calendar year set forth thereon at 365 equal units, and the second scale having a first information segment showing the menstrual cycle days ranging between 35 days and 20 days, and a second information segment representing the optimum fertility information segment formed by a series of 4 units, each unit being exactly double the size of the units set forth on the first scale, and a third information marker, which is set forward a distance of exactly 10 units of the size shown in the first scale, the information marker when placed in proper registry with respect to the first scale will show when the next menstrual cycle commenced; and, FIG. 2 is a side elevational view showing the manner in which the first scale and the second scale are rotatably mounted with respect to each other in order to achieve the calculating function of the present invention.
Figure 2:
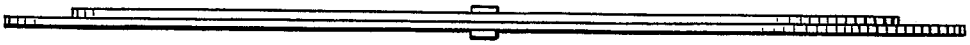

The calculator of the present invention is set forth in FIG. 1 of the drawings. It will be noted by viewing both FIGS. 1 and 2 of the drawings, that the calculator generally defined by the numeral 10 includes a first base scale 12 and a second scale 15 mounted in operative relationship relative to the first base scale 12. As shown in FIG. 2 of the drawings, the second scale 15 and the first scale 12 are mounted in operative relation by means of a pivot pin 18 such that the two scales are rotatably movable one with respect to the other.

As illustrated in FIG. 1, the first base scale 12 is provided with 365 equal units 20, each unit representing a day of a calendar year. As further shown in FIG. 1, the first base scale 12 is further constructed indicating each of the months of the year, with each of the days of each month clearly designated by a unit 20. The information contained in the first base scale 12 may be conveniently applied to the first scale by printing the same or utilizing any type of an overlay process to imprint the information thereon.

The second scale 15 is shown to include a first information segment 25 which is shown to be formed by a series of 15 units 28. Each unit 27 is dimensionally sized to be equal to the units 20 identified and shown in the first scale 12. Each of the units 27 represents a menstrual cycle of a given number of days ranging between 20 days and 35 days. It will further be noted that the first information segment 25 is laid out in a right to left fashion, with the lowest number of menstrual cycle days being 20 located to the right, and increasing in cycle lengths from right to left such that the largest menstrual cycle time span of 35 days would be 15 units to the left of the information segment when viewed from the top as illustrated in FIG. 1. It will be appreciated from a view of FIG. 1 of the drawings that each of the units 27 and the information segment 25 may be placed in registry with corresponding day units 20 located on the first base scale.

The second scale 15 is shown to further include a second information segment 30 which is spaced to the right of the first information segment 25, once again when viewed from the top as shown in FIG. 1 of the drawings. The second information segment 30 represents the optimum fertility information segment, and is shown to be formed by a series of 4 units 32, each of the units 32 being exactly double the dimensional sizing of the units 27 in the first information segment, and/or the units 20 shown on the first base scale. Furthermore, it will be noted that the second information segment 30 is spaced to the right of the first information segment 25 by a distance equalling exactly two of the units 20. It will further be noted that the units 32 in the second information segment 30 are delineated by a series of five markers 34 including a center marker 36. The center marker 36 represents the day of ovulation when the fertility calculator of the present invention is properly utilized. The four units to either side of the center marker 36 represent the 4 days prior to and subsequent to the day of ovulation and together constitute the optimum fertility time period which the user will determine in a manner more fully described herein after.

The second scale 15 is completed by a third information marker 40 which is positioned forwardly of the second information segment 30 by a distance equalling exactly ten units 20 shown on the first scale 12. The third information marker when properly placed in registry with a corresponding day or unit 20 on the first base scale 12 will indicate the day upon which the next menstrual cycle commences.

In constructing the calculator of the present invention, clearly, the first base scale 12 simple represents a 365 day year and is constructed by applying 365 units spaced equidistant around the periphery of the circular scale 12. As to the second scale 15, the first information segment 25 is constructed with fifteen units 27, the fifteen units 27 representing a cycle day in the number of menstrual cycles ranging between 20 menstrual cycle days and 35 menstrual cycle days. As indicated previously, this is considered to be the range within which most women will commence and end a menstrual cycle. It is to be further noted that the second information segment 30 is spaced precisely two units to the right of the first information segment, and consists of four units 32 which ar exactly double the size of the units 20 located on the first base scale 12. Hence, the number of units consumed as between the first information segment 25, and the second information segment 30, as well as the spacing therebetween, amounts to twenty-five units. The third information marker 40 is positioned precisely a distance equal to ten units as measured by units 20 on the first base scale 12, and it has been determined that with this spacing, the calculator will function for the purpose intended.

It will further be noted that with this construction the number of cycle days in a menstrual cycle will be the same number as the distance between the menstrual cycle length, and the distance to the third information marker 40. For example, from viewing FIG. 1, if for example, a female has a 30 day menstrual cycle, it will be noted that there are exactly 30 units measured between the 30 day menstrual cycle unit as shown in the first information segment 25, and measured to the third information segment 40. Similarly, if a female has a 25 day menstrual cycle, it will be noted that there are exactly 25 unit spaces as between the 25th day menstrual cycle notation in the first information segment 25, and the third information segment marker 40. Hence, the spacing and positioning of each of the three information segments 25, 30 and 40 respectively, must necessarily be laid out as indicated in order for the subject calculator 10 to operate in the manner intended.

In use, the operator would merely position the unit representing the female's menstrual cycle length, such as 30 for example, from the first information segment 25 located on the second scale 15, and place that number in registry with the day of the month upon which the previous menstrual cycle commenced. As shown in FIG. 1, if the female's menstrual cycle is a 30 day cycle, and the previous menstrual cycle commenced on the 23rd of June, the second scale 15 would be manipulated relative to the first scale 12 such that the number 30 of the first information segment 25 would be positioned on June 23. This will necessarily bring the optimum fertility information segment 30 into registry with certain given days in the month of July. As shown in figure 1, in such a situation, the ovulation marker 36 would be positioned on July 9, and that would indicate to the user that ovulation will occur on July 9. Further, the markers to the left and to the right of the ovulation marker 36 cover the time span from July 5, to July 13, and would indicate to the user the 8 day time period which is the optimum fertility time period, or the time period when conception is most likely. Further, it will be observed that the third information marker 40 is positioned on July 23, which would indicate to the user the day upon which the next menstrual cycle should commence.

It will also be appreciated that by showing the period of optimum fertility, the calculator is further designed to show those time periods when fertility is most unlikely to occur. Hence, the further away one gets from the second optimum fertility information segment 30, the greater are the chances of infertility. Hence, the calculator 10 of the present invention also provides to the user an efficient and easy to use device for avoiding conception as well.

It is further believed that by first utilizing a calculator construction in accordance with the present invention, attempts to achieve conception nay be enhanced and perhaps permit the female to avoid any subsequent mode of hormonal treatment or other types of treatment as an inducement to achieve conception. Obviously, if after several attempts of attempting conception do not have results, despite the use of the calculator 10 of the present invention, it is then very possible that other physical or hormonal problems may exist, and therefore, a mode of treatment may be indicated. It is contemplated, however, that by first utilizing the calculator of the present invention, the female may be able to at least achieve conception without the need of any treatment and at least known that the possibility of conception was attempted at the proper times.

While the present invention is indicated to be a calculator designed in circular configuration, it will be appreciated that various modifications may be made therein without changing the essence of the invention. For example, it is possible that the calculator of the present invention may constructed in a lineal fashion in the nature of a slide rule, but it is contemplated that if the calculator is constructed in accordance with the calculations and the spacing requirements described herein, the calculator should operate in the same manner to efficiently yield the same information.

While there has therefore been described what is considered to be a preferred embodiment of the invention, clearly various modifications may be made therein without departing from the true spirit and scope of the invention, and it intended to cover the appended claims all such modifications as fall within the true spirit and scope of the present invention.

We claim:

1. A fertility calculator adapted to determine optimum fertility time periods regardless of variations in menstrual cycle lengths, and calculated on the basis of ovulation occurring approximately 14 days prior to the commencement of the next menstrual cycle, comprising in combination, a first scale disk having the circumference thereof divided into 365 equal units, each unit representing a day in each month of a full calendar year, a second scale disk being affixed to and positioned in rotatable operative relation to said first scale disk, said second scale disk including:

(a) a first information segment formed thereon and divided into 15 equal units, each unit representing a day in a menstrual cycle selected from a range of menstrual cycles between 20 mentrual cycle days and 35 menstrual cycle days, (b) a second information segment consisting of an optimum fertility information segment divided into 4 equal units, each unit being exactly double the size of the units set forth on the first scale disk, said second information segment being spaced forwardly from said first information segment by 2 unit lengths, said unit lengths being the same unit lengths as said units contained in said first information segment, said second optimum fertility information segment representing a time period equal to 4 days before and 4 days following ovulation, whereby a particular optimum fertility time period may be determined by aligning the first determined day of a designated menstrual cycle length of the appropriate first information segment of said second scale disk with the month and day of the occurrence of the menstrual cycle on said first scale disk by rotating said second scale disk with respect to said first scale disk, thereby to align in the optimum fertility indicator segment on said second scale disk with a designated portion of said first scale disk to effectively determine the designated days of a particular month for the optimum fertility time period.

2. The optimum fertility calculator as set forth in claim 1 above, wherein said second scale disk further includes an information marker positioned forwardly of said second optimum fertility information segment, a distance of exactly 10 units of the same size as said units on said first scale disk, said information marker when aligned properly with respect to said first scale disk representing information showing the date upon which the next menstrual cycle will commence.

3. The optimum fertility calculator as set forth in claim 1 above, wherein said first scale disk is constructed in a circular configuration having a fixed diameter and having said 365 equal units designating calendar days circumferentially disposed thereabout, and said second scale disk is similarly constructed in a circular configuration having a fixed diameter smaller than said first scale disk and having said first information segment, said second optimum fertility information segment and said information marker formed thereon, said first and second scale disks being rotatably mounted to one another such that designated information on said second scale disk may be positioned in registry with designated information on said first scale disk thereby to permit information contained in said information segments to be aligned with the appropriate calendar days designated on said first scale disk to provide optimum fertility time period information to the user thereof.

4. The optimum fertility calculator as set forth in claim 1 above, wherein said second optimum fertility indicator segment spaced forwardly from said first information segment by a distance of 2 units, said units being measured in accordance with the unit size designated on said first scale, and said information marker is spaced forwardly of said second optimum fertility indicator segment by a distance of 10 units, said units being of the same size as said units positioned on said first scale disk.

5. The optimum fertility calculator as set forth in claim 4 above, wherein said first information segment is constructed and divided into 15 units, each of the units being sized as the same as said units on said first scale disk, each unit representing a particular menstrual cycle selected from a range of menstrual cycles between 20 menstrual cycle days and 35 menstrual cycle days, and said second information segment consisting of said optimum fertility indicator information segment divided into 4 units, each of the units therein being exactly double the size of the units of said first information segment, and representing a total of 8 days consisting of 4 days prior to and 4 days subsequent to the day of ovulation.

* * * * *